United States Patent [19]

Okado et al.

[11] 4,294,094

[45] Oct. 13, 1981

[54] METHOD FOR AUTOMATICALLY CONTROLLING WIDTH OF SLAB DURING HOT ROUGH-ROLLING THEREOF

[75] Inventors: Masaru Okado, Tokyo; Takashi Ariizumi, Yokohama, both of Japan

[73] Assignee: Nippon Kokan Kabushiki Kaisha, Tokyo, Japan

[21] Appl. No.: 117,272

[22] Filed: Jan. 31, 1980

[30] Foreign Application Priority Data

Feb. 24, 1979 [JP] Japan ..... 54-20213

[51] Int. Cl.[3] ..... B21B 1/04; B21B 27/02; B21B 37/00

[52] U.S. Cl. ..... 72/16; 72/234; 72/199

[58] Field of Search ..... 72/6–12, 72/234, 366, 199

[56] References Cited

U.S. PATENT DOCUMENTS 3,543,548 12/1970 Smith, Jr. ..... 72/7

FOREIGN PATENT DOCUMENTS 50-90560 7/1975 Japan .

52-34029 9/1977 Japan .

*Primary Examiner*—Milton S. Mehr

*Attorney, Agent, or Firm*—Frishauf, Holtz, Goodman & Woodward

[57] ABSTRACT

A method for automatically controlling the width of a slab during hot rough-rolling thereof, which comprises: arranging a pair of horizontal broadening rolls each having at least one annular projection in a hot roughing mill train comprising a plurality of roll stands; calculating an amount of roll gap correction of said pair of broadening rolls on the basis of the variation in the width of said slab during hot rough-rolling on said hot roughing mill at the entry of said pair of broadening rolls; and, controlling the roll gap of said pair of broadening rolls in response to said amount of roll gap correction; thereby automatically controlling the width of said slab during hot rough-rolling thereof to a prescribed value at a high accuracy in accordance with the finishing width of a steel strip, and at the same time, automatically correcting variations in the width of said slab during hot rough-rolling thereof at a high accuracy.

10 Claims, 7 Drawing Figures

METHOD FOR AUTOMATICALLY CONTROLLING WIDTH OF SLAB DURING HOT ROUGH-ROLLING THEREOF

FIELD OF THE INVENTION

The present invention relates to a method for automatically controlling the width of a slab at a high accuracy to a prescribed value during hot rough-rolling thereof, and at the same time, automatically correcting variations in the width of the slab at a high accuracy during hot rough-rolling thereof.

BACKGROUND OF THE INVENTION

A slab fed as the material to be rolled to a hot roughing mill of a hot strip mill has conventionally been manufactured by slabbing a steel ingot. Since, in the slabbing process, the slab width has been determined with the finishing width of a steel strip in view, the amount of slab edging by a hot roughing mill (i.e., the difference between the width of the slab fed to the hot roughing mill and the finishing width of a steel strip) has been relatively small as from about 10 to about 20 mm.

In the meantime, the continuous casting process which has various advantages over the slabbing process has recently been industrialized and has become popular in many applications, and this has made it difficult to feed many kinds of slabs with different widths to a hot roughing mill. The reason is that, in the continuous casting process, it is impossible to alter the slab width unless the mold is replaced, and this mold replacement causes a serious decrease in the productivity of slabs by the continuous casting process. As a result, the amount of slab edging by a hot roughing mill has largely increased to a value of from about 50 to about 75 mm.

In order to manufacture a steel strip at a satisfactory width accuracy by a hot finishing mill under such circumstances, it is particularly important to control the width of a slab during hot rough-rolling thereof. Major factors causing the occurrence of variations in the slab width during hot rough-rolling of the slab include those based on the slab fed to the hot roughing mill, and those based on heating and hot rough-rolling of the slab. Factors based on the slab fed to the hot roughing mill include the variation in the thickness and the width of the slab, the variation in slab dimensions caused by the local scarfing of the slab, and the variation in deformation resistance caused by the variations in the chemical composition of the slab. Factors based on heating of the slab are, for example, skid marks and the variation in deformation resistance caused by the non-uniformity of heating temperature in the heating furnace. Factors based on hot rough-rolling of the slab include the broadening of the slab width during rolling by horizontal rolls of the hot roughing mill, and the local narrowing of the slab width at the top portion and the bottom portion of a slab caused by the metal flow during rolling by vertical rolls of the hot roughing mill.

With reference to these various causes mentioned above, the state of variations in the slab width in the course of hot rough-rolling of a slab are shown in FIG. 1. In FIG. 1, (1) is the top portion of the slab; (2) is the middle portion of the slab; and, (3) is the bottom portion of the slab. As shown in FIG. 1, during hot rough-rolling in general, a serious narrowing of width occurs at the top portion (1) and the bottom portion (2) of the slab, and a variation in the width is observed also at the middle portion (2) of the slab.

There is conventionally known a method for correcting variations in the slab width during hot rough-rolling which comprises controlling the slab width principally by adjusting the roll gap of the vertical rolls of a hot roughing mill in response to the variation in the slab width. The following methods and apparatus have been proposed:

(1) A method, disclosed in Japanese Patent Provisional Publication No. 90,560/75 dated July 19, 1975, which comprises:

detecting the width of a slab transferred to a hot roughing mill provided with vertical rolls by means of a slab width detector installed at the entry or at the exit of said hot roughing mill;

calculating the deviations of the values thus detected from the target slab width at the entry or at the exit of said hot roughing mill; and, controlling the slab width by adjusting the roll gap of said vertical rolls in response to said deviations (hereinafter referred to as the "prior art (I)").

(2) An apparatus, disclosed in Japanese Patent Publication No. 34,029/77 dated Sept. 1, 1977, which comprises:

a slab width measuring device for measuring the width of a slab at the exit of vertical rolls of a hot roughing mill in accordance with signals from a rolling load detector of said vertical rolls and a roll gap detector of said vertical rolls;

a slab width calculating device for performing a predicting calculation of the slab width at the exit of horizontal rolls of the hot roughing mill in accordance with the amount of slab width broadening caused by said horizontal rolls previously calculated and the signal from said slab width measuring device;

a slab width setting device for calculating a new slab width setting value, which predicts the effects acting on the finishing width of a steel strip at the final roll stand of a hot finishing mill, with the use of the width correcting coefficient of the steel strip at the exit of the final roll stand of the hot finishing mill and the width correcting coefficient of the slab at the exit of the final roll stand of the hot roughing mill; and, a roll gap correction calculating device for calculating a roll gap correction value for the vertical rolls on the basis of signals from said slab width calculating device and said slab width setting device (hereinafter referred to as the "prior art (II)").

However, both the prior arts (I) and (II) presented above, in which the slab width is controlled during hot rough-rolling by adjusting the roll gap of vertical rolls, have the following problems:

(a) Control of the slab width by vertical rolls increases the ratio of crop loss occurring in the slab;

(b) For the purpose of increasing the control accuracy of slab width, it is desirable to effect adjustment of the slab width by the vertical rolls in the downstream of the hot roughing mill train as far as possible. The slab thickness decreases, on the other hand, toward the downstream of the hot roughing mill train. Adjustment of the slab width by the vertical rolls in the downstream of the hot roughing mill train may therefore cause buckling of the slab under the effect of the vertical rolls; and, (c) As compared with horizontal rolls, vertical rolls are poor in the accuracy of roll gap adjustment and the roll gap response characteristics because of their structure. The control accuracy of slab width by the vertical rolls is therefore lower than that by the horizontal rolls.

SUMMARY OF THE INVENTION

A principal object of the present invention is to provide a method for automatically controlling the width of a slab during hot rough-rolling thereof to a prescribed value at a high accuracy in accordance with the finishing width of a steel strip.

Another object of the present invention is to provide a method for automatically correcting variations in the slab width during hot rough-rolling at a high accuracy.

An additional object of the present invention is to provide a method for hot rough-rolling a slab, which gives a smaller ratio of crop loss.

In accordance with one of the features of the present invention, there is provided a method for automatically controlling the width of a slab during hot rough-rolling thereof, which comprises:

arranging a pair of horizontal broadening rolls each having at least one annular projection in a hot roughing mill train comprising a plurality of roll stands each having a pair of vertical rolls and a pair of horizontal rolls;

calculating an amount of roll gap correction of said pair of broadening rolls on the basis of the variation in the width of said slab during hot rough-rolling by said hot roughing mill, at the entry of said pair of broadening rolls; and, controlling the roll gap of said pair of broadening rolls in response to said amount of roll gap correction;

thereby automatically controlling the width of said slab during hot rough-rolling thereof to a prescribed value in accordance with the finishing width of a steel strip, and at the same time, automatically correcting variations in the width of said slab during hot rough-rolling thereof.

BRIEF DESCRIPTION OF THE DRAWINGS

FIG. 3 (B) is a front view illustrating another embodiment of the horizontal broadening roll having two annular projections, used in the present invention;

DETAILED DESCRIPTION OF PREFERRED EMBODIMENTS

With a view to solving the above-mentioned problems involved in the conventional method and apparatus for automatically controlling the width of a slab during hot rough-rolling thereof, we carried out extensive studies, and as a result, obtained the following finding:

When locally reducing a slab by horizontal rolls of a hot roughing mill, metal flow in the longitudinal direction of the slab is restrained by the portion of slab not rolled. Consequently, the slab is hardly rolled in the longitudinal direction, but mostly rolled in the width direction. It is therefore possible to conduct broadening of a slab width and correction of the slab width, easily and accurately, by locally reducing the slab during hot rough-rolling thereof, by a pair of horizontal rolls each having at least one annular projection.

The present invention was made with reference to the above-mentioned finding, and the method of the present invention comprises: arranging a pair of horizontal broadening rolls each having at least one annular projection in a hot roughing mill train comprising a plurality of roll stands, and, during hot rough-rolling of a slab by said hot roughing mill, adjusting the roll gap of said pair of broadening rolls in response to variations in the width of said slab, thereby automatically controlling the width of said slab during hot rough-rolling thereof to a prescribed value at a high accuracy in accordance with the finishing width of a steel strip, and at the same time, automatically correcting variations in the width of said slab during hot rough-rolling thereof at a high accuracy.

The method for automatically controlling the width of a slab during hot rough-rolling thereof of the present invention is described in detail with reference to the drawings.

Figure 1:
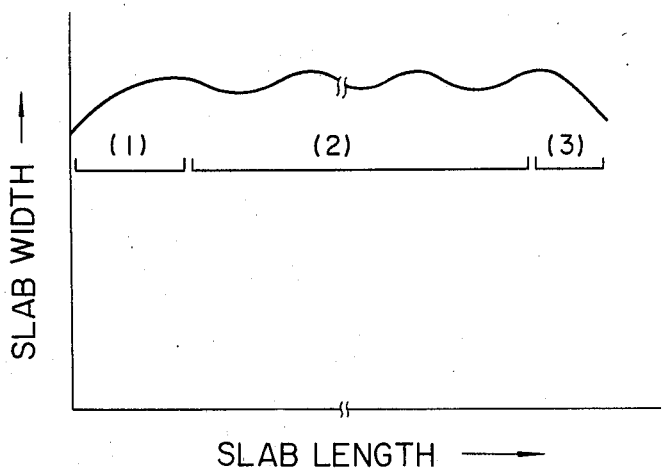
FIG. 1 is a drawing illustrating variations in the width of a slab occurring during hot rough-rolling of the slab.
Figure 2:
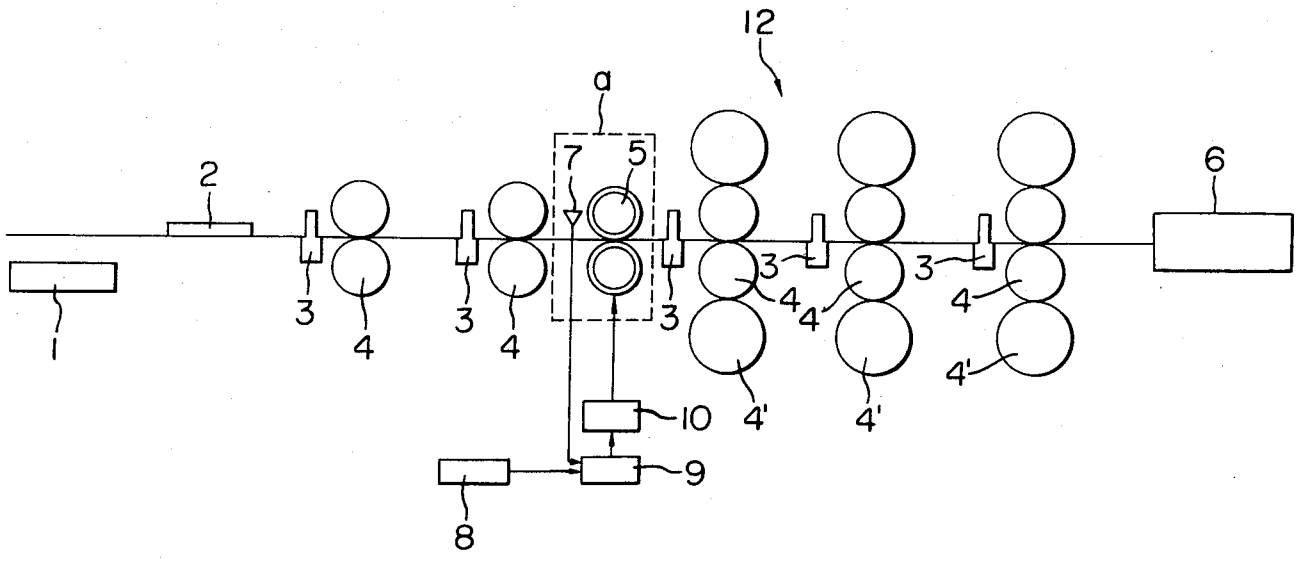
FIG. 2 is a schematic descriptive drawing illustrating an embodiment of the method of the present invention.

FIG. 2 is a schematic descriptive drawing illustrating an embodiment of the method of the present invention. In FIG. 2, 1 is a heating furnace; 2 is a slab heated to a prescribed temperature in the heating furnace 1; 12 is a conventional hot roughing mill comprising a plurality of roll stands; and 6 is a conventional hot finishing mill, comprising a plurality of roll stands, arranged on the exit side of the final roll stand of the hot roughing mill 12. Each of the roll stands of the hot roughing mill 12 includes a pair of vertical rolls 3 and a pair of horizontal rolls 4, and the pair of horizontal rolls 4 are located downstream of the pair of vertical rolls 3. Some of the pairs of horizontal rolls 4 are equipped with backup rolls 4'. FIG. 2 shows a hot roughing mill comprising five roll stands, but it is needless to mention that the number of roll stands is not limited to five. The slab 2 heated to a prescribed temperature in the heating furnace 1 is rough-rolled by the hot roughing mill 12 into a bar, an intermediate product, and the bar thus obtained is then rolled by the hot finishing mill 6 into a steel strip, the final product.

In FIG. 2, 5 are a pair of horizontal broadening rolls each having at least one annular projection (hereinafter referred to as the "broadening rolls"), arranged in the train of the hot roughing mill 12; 7 is a slab width detector for measuring the width of the slab 2 at the entry of the pair of broadening rolls 5, provided upstream of the pair of broadening rolls 5; 8 is a rolling pass schedule calculating device; 9 is a roll gap correction calculating device; and 10 is a roll gap controller for the pair of broadening rolls 5.

Use of the horizontal broadening rolls each having at least an annular projection is emphasized. The pair of broadening rolls 5 is the most important feature of the present invention.

Figure 3A:
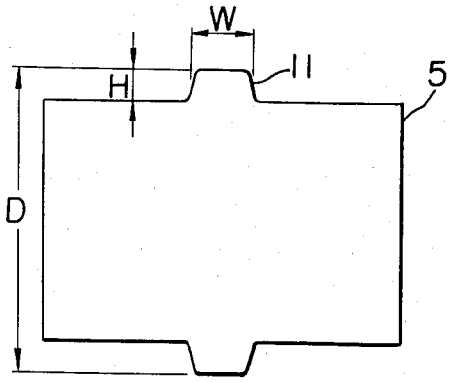
FIG. 3 (A) is a front view illustrating an embodiment of the horizontal broadening roll having an annular projection, used in the present invention.
Figure 3B:
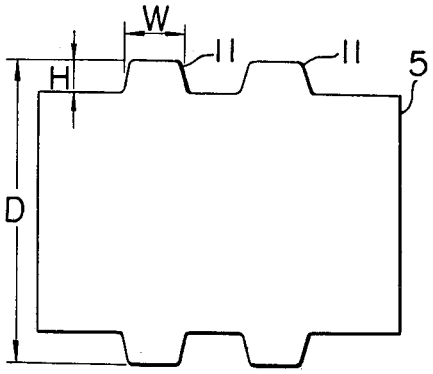

FIG. 3 (A) is a front view illustrating the broadening roll 5 having one annular projection 11, for use in the present invention. The annular projection 11 is formed at right angles to the axial center of the broadening roll 5 along the circumference of the broadening roll 5. As shown in FIG. 3 (B), two annular projections 11 as mentioned above may be formed. In all cases, in order to effectively control the broadening of the width of the slab 2, the annular projection(s) 11 should satisfy the following two formulae:

$$\Sigma W \leqq (\text{Bar width})/2, \text{ and}$$

$$H \geqq (\text{Reduction})/2,$$

where, $\Sigma W$: total of the width "W" of at least one annular projection 11 of the broadening roll 5; and H: height of the annular projection 11.

The pair of broadening rolls 5 are arranged within the train of the hot roughing mill 12. According to our experience, installation thereof before the roll stand in the downstream of the hot roughing mill train 12 as far as possible, gives better results when the manufactured bar has a larger thickness. FIG. 2 shows the case where the pair of broadening rolls 5 are arranged upstream of the No. 3 roll stand.

The slab width detector 7 provided upstream of the pair of broadening rolls 5 measures the width of the slab 2 at the entry of the pair of broadening rolls 5. As the slab width detector 7, an infrared type width gauge meter or a backlight type width gauge meter may be used to directly detect the width of the slab 2, or, as the slab width detector 7, a pair of vertical rolls (not shown) may be provided upstream of the pair of broadening rolls 5 to indirectly detect the width of the slab 2 from the rolling load acting on said pair of vertical rolls and the roll gap of said pair of vertical rolls. In the latter case, the slab width, "$B_{M\,in}$", at the entry of the pair of broadening rolls 5 is calculated by the following formula:

$$B_{Min} = B_E + \frac{P_E}{M}$$

where, $B_{M\,in}$: roll gap of the pair of vertical rolls, $P_E$: rolling load acting on the pair of vertical rolls, and M: mill constant for the pair of vertical rolls.

The rolling pass schedule calculating device 8 calculates a rolling pass schedule composed of a vertical reduction schedule for the several pairs of vertical rolls 3 of the hot roughing mill 12, a horizontal reduction schedule for the several pairs of horizontal rolls 4 of the hot roughing mill 12, and another horizontal reduction schedule for the pair of broadening rolls 5, from such parameters as the measured thickness and the measured width of the slab 2 to be fed to the hot roughing mill 12, the steel grade of the slab 2, the extraction temperature of the slab 2 from the heating furnace 1, and the target thickness and the target width of the bar to be manufactured, and stores the rolling pass schedule thus calculated.

The roll gap correction calculating device 9 calculates the amount of correction of the roll gap for the pair of broadening rolls 5, established by the rolling pass schedule calculating device 8, on the basis of the deviations of the measured width of the slab 2 at the entry of the pair of broadening rolls 5, sent from the slab width detector 7, from the predicted slab width of the slab 2 at the entry of the pair of broadening rolls 5, included in the horizontal reduction schedule for the pair of broadening rolls 5, sent from the rolling pass schedule calculating device 8.

The roll gap controller 10 controls the roll gap of the pair of broadening rolls 5 in response to signals sent from the roll gap correction calculating device 9.

Figure 4:
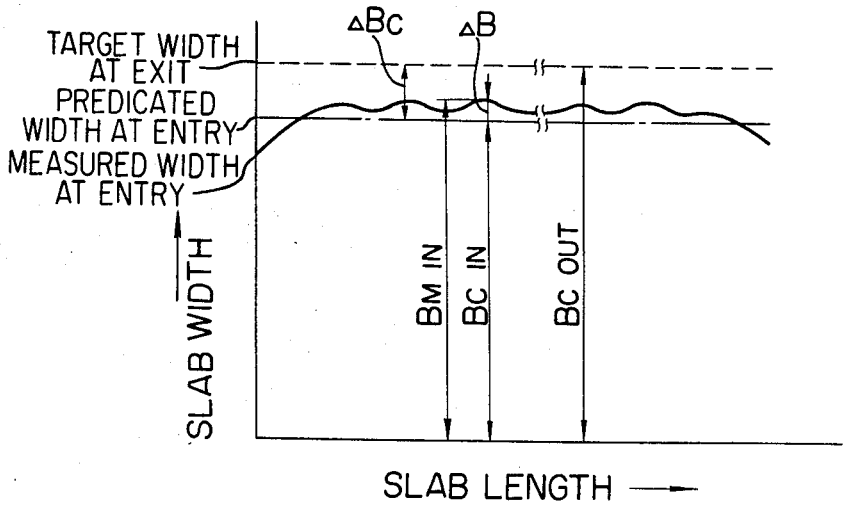
FIG. 4 is a drawing illustrating an embodiment of broadening of a slab width and correction of the slab width by a pair of horizontal broadening rolls each having at least one annular projection used in the present invention.

In the method of the present invention, as shown in FIG. 4, the roll gap of the pair of broadening rolls 5 is adjusted on the basis of the deviations, "ΔB", of the measured width, "$B_{M\,in}$", of the slab 2 at the entry of the pair of broadening rolls 5, and the predicted width, "$B_{C\,in}$", of the slab 2 at the entry of the pair of broadening rolls 5, so that the width of the slab 2 at the exit of the pair of broadening rolls 5 matches with the target width, "$B_{C\,out}$".

In other words, when the slab 2 fed to the hot roughing mill 12 reaches the position of the slab width detector 7, the measured width, "$B_{M\,in}$" of the slab 2 at the entry of the pair of broadening rolls 5 is detected by the slab width detector 7, and said detected value of the measured width, "$B_{M\,in}$", is sent to the roll gap correction calculating device 9. On the other hand, the predicted width, "$B_{C\,in}$", of the slab 2 at the entry of the pair of broadening rolls 5, set by the rolling pass schedule calculating device 8, is also sent to the roll gap correction calculating device 9, where the deviations, "ΔB", of said measured width, "$B_{M\,in}$", from said predicted width, "$B_{C\,in}$", are calculated, and then, the amount of roll gap correction for the pair of broadening rolls 5 is calculated on the basis of said deviations, "ΔB". The amount of roll gap correction is calculated by the following formula:

$$\text{Amount of roll gap correction} = \sqrt[no]{\frac{\Delta B_C - \Delta B}{C \cdot f(h,B,D)}} - \Delta H_{C\,set} \quad (1)$$

In the formula (1), "$\Delta B_C$" is the amount of width broadening of the slab 2 at the exit of the pair of broadening rolls 5, and is calculated by the following formula:

$$\Delta B_C = C \cdot \Delta H_{C\,set}^{no} \cdot f(h, B, D) \quad (2)$$

In the formulae (1) and (2):

$\Delta H_{C\,set}$: initially set reduction of the pair of broadening rolls 5;

h: thickness of the slab 2 at the entry of the pair of broadening rolls 5;

B: width of the slab 2 at the entry of the pair of broadening rolls 5;

D: outside diameter of the broadening roll 5 including the annular projection thereof; and, C, $n_0$: constants dependent on the steel grade and the extraction temperature from the heating furnace 1 of the slab 2.

The calculated value thus obtained of the amount of roll gap correction for the pair of broadening rolls 5 is sent to the roll gap controller 10, and the roll gap of the pair of broadening rolls 5 set by the rolling pass schedule calculating device 8 is controlled by the roll gap controller 10 in response to said calculated value of the amount of roll gap correction, thereby accurately controlling the width of the slab during hot rough-rolling thereof to a prescribed value, and at the same time, accurately correcting variations in the slab width.

Figure 5:
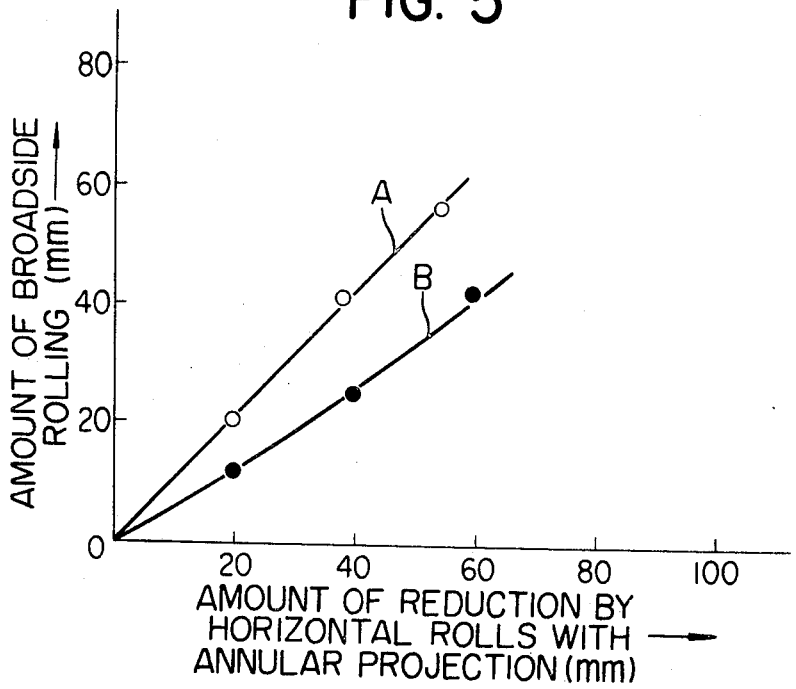
FIG. 5 is a graph illustrating the relationship between the amount of slab reduction and the amount of width broadening of the slab in the case where a slab is reduced by a pair of horizontal broadening rolls each having at least one annular projection used in the present invention; and, FIG. 6 is a drawing illustrating another embodiment of broadening of a slab width and correction of the slab width by a pair of horizontal rolls each having at least one annular projection used in the present invention.

FIG. 5 is a graph illustrating the experimental data showing the relationship between the amount of reduction and the amount of width broadening of the slab 2 in the case where the slab 2 is reduced by the pair of broadening rolls 5. Table 1 shows the rolling conditions of the slab 2 in this experiment.

TABLE 1

| | Rolling conditions A | Rolling conditions B |
|---|---|---|
| Steel grade of slab | Low carbon steel (C: 0.06 wt.%) | Low carbon steel (C: 0.06 wt.%) |
| Extraction temperature of slab from heating furnace (°C.) | 1,250 | 1,280 |
| Slab thickness (mm) | 190 | 205 |
| Slab width (mm) | 900 | 1,250 |
| Outside diameter of broadening roll including annular projection(s) (mm) | 1,100 | 1,160 |
| Number of annular projections | 1 | 2 |
| Height of annular projection (mm) | 40 | 30 |
| Width of annular production (mm) | 300 | 400 |
| Revolutions of broadening roll having annular projection(s) (rpm) | 18.4 | 18.4 |

In FIG. 5, the line connecting the marks "o" indicates the case where the slab is reduced under the rolling conditions "A" as given in Table 1, and the line connecting the marks "•" represents the case where the slab is reduced under the rolling conditions "B" as given in Table 1. As is clear from FIG. 5, use of the pair of broadening rolls 5 permits effective broadening of the slab width in proportion to the amount of reduction in the both cases.

The combination "a" (the portion enclosed by dotted lines in FIG. 2) of the slab width detector 7 and the pair of broadening rolls 5 may be any of the following combinations, in addition to that described above:

(1) A width gauge meter or a pair of vertical rolls as the slab width detector 7; a pair of broadening rolls 5 capable of adjusting the roll gap, installed downstream of the slab width detector 7; and another pair of broadening rolls (not shown) not capable of adjusting the roll gap, installed downstream of said pair of broadening rolls capable of adjusting the roll gap;

(2) A pair of broadening rolls not capable of adjusting the roll gap (not shown); a width gauge meter or a pair of vertical rolls, as the slab width detector 7, installed in the downstream of said pair of broadening rolls; and, another pair of broadening rolls capable of adjusting the roll gap, installed downstream of said slab width detector 7; and (3) A width gauge meter or a vertical roll as the slab width detector 7; a pair of horizontal rolls installed in the downstream of said slab width detector 7; and a pair of broadening rolls capable of adjusting the roll gap, installed in the downstream of said pair of horizontal rolls.

The method of the present invention described above, which comprises measuring variations in the slab width at the entry of the pair of broadening rolls 5 by the slab width detector 7, and controlling the roll gap of the pair of broadening rolls 5 installed in the downstream of the slab width detector 7 in response to said variations in the slab width, is called the feed-forward control method. Now, the following paragraphs explain another control method called the preset control method, which comprises controlling the roll gap of the pair of broadening rolls 5 by predicting by calculation the variations in the slab width at the entry of the pair of broadening rolls 5 from such rolling conditions as the measured thickness and the measured width of the slab at the entry of the hot roughing mill 12, the steel grade of the slab, the extraction temperature of the slab from the heating furnace 1, the target thickness and the target width of the bar, and by presetting the roll gap of the pair of broadening rolls 5 on the basis of the result of said predicting calculation. In the preset control method, a slab width detector 7 is not necessary, since the slab width at the entry of the pair of broadening rolls 5 is predicted by calculation.

The preset control method includes the following two control methods:

(1) The tabulation of method, which comprises tabulation variations in the predicted slab width at the entry of the pair of broadening rolls 5, and presetting the roll gap of the pair of broadening rolls 5 on the basis of this tabulation; and, (2) The pattern calculation method, which comprises converting variations in the predicted slab width at the entry of the pair of broadening rolls 5 into a pattern, and presetting the roll gap of the pair of broadening rolls 5 on the basis of this pattern.

Both the tabulating method and the pattern calculation method are slab width control methods adapted to correct the narrowing of slab width occurring in top and bottom portions of a slab.

The tabulation method is first described.

The tabulation method comprises predicting by calculation the variation in the width of the slab 2 at the entry of the pair of broadening rolls 5 in accordance with the predicting formulae of slab width variation (3), (4), (5) and (6) described later; preparing a table on the basis of the results of said predicting calculation; entering said table into the rolling pass schedule calculating device 8 for storage; calculating the amount of necessary width broadening at the top portion and the bottom portion of the slab at the exit of the pair of broadening rolls 5 and the amount of roll gap correction for the pair of broadening rolls 5, by the roll gap correction calculating device 9, in accordance with the formulae (7), (8) and (9) described later, on the basis of the table stored in the rolling pass schedule calculating device 8; and, controlling the roll gap of the pair of broadening rolls 5 by the roll gap controller 10, on the basis of said amount of roll gap correction; thereby automatically controlling the width of the slab during hot rough-rolling thereof to a prescribed value at a high accuracy, and at the same time, automatically correcting variations in the width of the slab during hot rough-rolling thereof at a high accuracy.

The predicting formulae of width variation of the slab 2 at the entry of the pair of broadening rolls 5 described above are as follows:

$$\Delta B_{Ti} = \Delta B_{Eti} + \Delta B_i - \Delta b_{Ti} \quad (3)$$
$$\Delta B_{Eti} = (C_1 \cdot B_{i-1} + C_2) \cdot H_{i-1}^{n1} \cdot \Delta B_{Ei}^{n2}$$
$$\Delta b_{Ti} = (C_3 \cdot B_{i-1} \cdot \Delta H_{di} + C_4) \frac{H_i^{n3}}{H_{i-1}^{n4}} \cdot f(\Delta B_{Ei}, \Delta B_{Ti-1})$$
$$\Delta B_{Bi} = \Delta B_{E\,Bi} + \Delta B_i - \Delta b_{Bi} \quad (4)$$
$$\Delta B_{E\,Bi} \simeq 0$$
$$\Delta b_{Bi} = (C_5 \cdot B_{i-1} \cdot \Delta H_{di} + C_6) \frac{H_i^{n5}}{H_{i-1}^{n6}} \cdot f(\Delta B_{Ei}, \Delta B_{Bi-1})$$
$$L_{Ti} = \Delta L_{E\,Ti} \frac{H_{i-1}}{H_i} \cdot \alpha_{Ti} \quad (5)$$
$$\Delta L_{E\,Ti} = C_7 \cdot H_{i-1}^{n7} \cdot B_{Ei}^{n8}$$
$$\Delta L_{Bi} = \Delta L_{E\,Bi} \cdot \frac{H_{i-1}}{H_i} \alpha_{Bi} \quad (6)$$
$$\Delta L_{E\,Bi} = C_8 \cdot H_{i-1}^{n9} \cdot \Delta B_{Ei}^{n10}$$

in the above-mentioned formulae (3), (4), (5) and (6):

i: pass number of the hot roughing mill;

$\Delta B_{Ti}$: width shortage in the slab width direction at the top portion of said slab after horizontal reduction in the i-th pass;

$\Delta B_{Bi}$: width shortage in the slab width direction at the bottom portion of said slab after horizontal reduction in the i-th pass;

$\Delta B_{E\,Ti}$: width shortage in the slab width direction at the top portion of said slab after slab width reduction in the i-th pass;

$\Delta B_{E\,Bi}$: width shortage in the slab width direction at the bottom portion of said slab after slab width reduction in the i-th pass;

$\Delta b_{Ti}$: width broadening in the slab width direction at the top portion of said slab after horizontal reduction in the i-th pass;

$\Delta b_{Bi}$: width broadening in the slab width direction at the bottom portion of said slab after horizontal reduction in the i-th pass;

$\Delta L_{Ti}$: width shortage in the slab longitudinal direction at the top portion of said slab after horizontal reduction in the i-th pass;

$\Delta L_{Bi}$: width shortage in the slab longitudinal direction at the bottom portion of said slab after horizontal reduction in the i-th pass;

$\Delta L_{E\,Ti}$: length of the dog bone at the non-stationary portion of the slab top portion after width reduction of said slab in the i-th pass;

$\Delta L_{E\,Bi}$: length of the dog bone at the non-stationary portion of the slab bottom portion after width reduction of said slab in the i-th pass;

$H_{i-1}$: slab thickness at the entry in the i-th pass;

$B_{i-1}$: slab width at the entry in the i-th pass;

$\Delta B_{Ei}$: slab width reduction in the i-th pass;

$\Delta H_i$: slab horizontal reduction in the i-th pass;

$\Delta B_i$: width broadening in the slab width direction at the stationary portion of said slab by horizontal reduction in the i-th pass;

$C_1 \sim C_8$: constants dependent on the steel grade of the slab, the slab extraction temperature from the heating furnace, the diameter of the vertical roll and other conditions;

$n_1 \sim n_{10}$: constants dependent on the steel grade of the slab, the slab extraction temperature from the heating furnace and other conditions;

$\alpha_{Ti}$: correction coefficient of elongation at the top portion of said slab; and, $\alpha_{Bi}$: correction coefficient of elongation at the bottom portion of said slab.

In "$\Delta L_{E\,Ti}$" and "$\Delta L_{E\,Bi}$", the length of the dog bone at the non-stationary portion means the slab longitudinal length at the top and the bottom portions where the dog bone height varies.

In "$\Delta Bi$", the width broadening in the slab width direction at the stationary portion of the slab means the amount of width broadening at portions other than the top and the bottom portions.

The formula for calculating the amount of necessary width broadening at the top portion and the bottom portion of the slab at the exit of the pair of broadening rolls 5, and the formula for calculating the amount of roll gap correction for the pair of broadening rolls 5 mentioned above are as follows:

The formula for calculating the amount of necessary width broadening at slab top portion "$\Delta B_C(lx)$":

$$\Delta B_C(lx) = \Delta B_C + \Delta B_T \left\{ 1 - \left( \frac{lx}{\Delta L_T} \right)^n \right\} \quad (7)$$

The formula of the amount of necessary width broadening at slab bottom portion, "$\Delta B_C(lx)$":

$$\Delta B_C(lx) = \Delta B_C + \frac{\Delta B_B}{(L - \Delta L_B)^\eta - L^\eta} \{(L - \Delta L_B)^n - lx^n\} \quad (8)$$

provided that, in the above-mentioned formulae (7) and (8), the amount of width broadening at the exit of the pair of broadening rolls 5, "$\Delta B_C$", is calculated by the following formula, as in the case of the aforementioned feed-forward control method:

$$\Delta B_C = C \cdot H_{C\,set}^{no} \cdot f(h, B, D).$$

The formula for calculating the amount of roll gap correction for the pair of broadening rolls 5:

$$\text{Amount of roll gap correction} = \sqrt[no]{\frac{\Delta B_C(lx)}{C \cdot f(h,B,D)}} - \Delta H_{C\,set} \quad (9)$$

Figure 6:
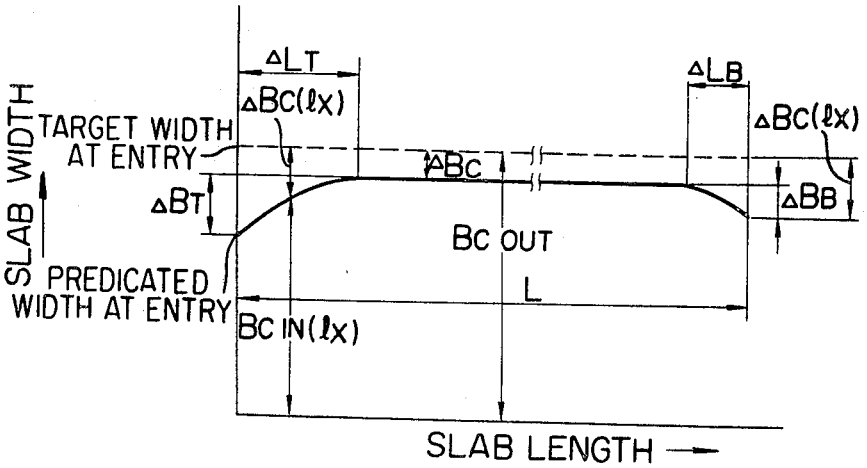

In the formulae (7), (8) and (9) (refer to FIG. 6):

$\Delta B_C$: amount of width broadening at the stationary portion of the slab;

$\Delta B_T$: width shortage in the slab width direction at the top portion of the slab;

$\Delta B_B$: width shortage in the slab width direction at the bottom portion of the slab;

$\Delta L_T$: width shortage in the slab longitudinal direction at the top portion of the slab;

$\Delta L_B$: width shortage in the slab longitudinal direction at the bottom portion of the slab;

L: longitudinal length of the slab;

lx: longitudinal length of the top portion of the slab from the top end thereof; and, n: index approximating variations in the slab width at the top portion and the bottom portion of the slab.

The procedure for preparing a table to be stored in the rolling pass schedule calculating device 8 is as follows. More specifically, rolling conditions such as the steel grade of the slab, the type of slab, the width of the slab, and the amount of slab edging, are classified, for example, as follows:

| | |
|---|---|
| Steel grade of slab | Carbon steel<br>Alloy steel |
| Type of slab | Ingot-cast slab (slab manufactured by the slabbing process)<br>Continuously cast slab (slab manufactured by the continuous casting process) |
| Slab width | from 600 mm to under 900 mm<br>from 900 mm to under 1,200 mm<br>from 1,200 mm to under 1,500 mm<br>from 1,500 mm to under 1,800 mm<br>from 1,800 mm to under 2,100 mm |
| Amount of slab edging | from −25 mm to under 0 mm<br>from 0 mm to under 25 mm<br>from 25 mm to under 50 mm<br>from 50 mm to under 75 mm |

A table is prepared on the basis of the rolling conditions as classified as mentioned above. Table 2 gives an example of a thus prepared table.

TABLE 2

| Rolling conditions | | Variation in width at slab top and bottom (mm) | | | |
|---|---|---|---|---|---|
| | | $\Delta B_T$ | $\Delta L_T$ | $\Delta B_B$ | $\Delta L_B$ |
| amount of slab edging (mm) | from 50 to under 75 | 20 | 1100 | 15 | 1000 |
| | from 25 to under 50 | 10 | 900 | 7 | 850 |
| | from 0 to under 25 | 5 | 700 | 0 | 0 |
| | from −25 to under 0 | 0 | 0 | 0 | 0 |
| Steel grade of slab | | Carbon steel | | | |
| Type of slab | | Continuously cast slab | | | |
| Slab width (mm) | | from 1200 to under 1500 | | | |

Now, the pattern calculation method is described below.

In the pattern calculation method, variations in the width of the slab 2 at the entry of the pair of broadening rolls 5 are calculated and converted into a pattern, by the rolling pass schedule calculating device 8, on the basis of the rolling conditions stored in the rolling pass schedule calculating device 8 and in accordance with the above-mentioned formulae for prediction (3) to (6). Furthermore, the amounts of necessary width broadening at the top portion and the bottom portion of the slab 2 at the exit of the pair of broadening rolls 5 are calculated and stored by the rolling pass schedule calculating device 8, on the basis of said variations in the width of the slab 2 converted into the pattern as mentioned above, and in accordance with the above-mentioned formulae (7) and (8). Then, the amount of roll gap correction for the pair of broadening rolls 5 is calculated by the roll gap correction calculating device 9 on the basis of said amounts of necessary width broadening at the top portion and the bottom portion of the slab 2 stored in the rolling pass schedule calculating device 8, and in accordance with the above-mentioned formula (9). Then, the roll gap of the pair of broadening rolls 5 is controlled by the roll gap controller 10 on the basis of said amount of roll gap correction, thereby automatically controlling the width of the slab during hot rough-rolling thereof to a prescribed value at a high accuracy, and at the same time, automatically correcting variations in the width of the slab during hot rough-rolling thereof at a high accuracy.

The pattern calculation method, which calculates the amounts of necessary width broadening at the top portion and the bottom portion of the slab at the exit of the pair of broadening rolls 5 on the basis of the variations in the slab width converted into a pattern, permits more accurate control of the slab width than in the tabulation method.

According to the method of the present invention, as mentioned above in detail, it is possible to accurately and automatically control the width of a slab during hot rough-rolling thereof to a prescribed value in accordance with the finishing width of the steel strip, and at the same time, accurately and automatically correcting variations in the width of the slab during hot rough-rolling thereof, thus providing industrially useful effects.

What is claimed is:

1. A method for automatically controlling the width of a slab during hot rough-rolling thereof, which comprises:

arranging a pair of horizontal broadening rolls each having at least one annular projection in a hot roughing mill train comprising a plurality of roll stands each having a pair of vertical rolls and a pair of horizontal rolls;

calculating an amount of roll gap correction of said pair of broadening rolls on the basis of variations in the width of said slab during hot rough-rolling by said hot roughing mill, at the entry of said pair of broadening rolls; and, controlling the roll gap of said gap of broadening rolls in response to said amount of roll gap correction;

thereby automatically controlling the width of said slab during hot rough-rolling thereof to a prescribed value in accordance with the finishing width of a steel strip, and at the same time, automatically correcting variations in the width of said slab during hot rough-rolling thereof.

2. The method as claimed in claim 1, which comprises:

detecting said variations in the width of said slab at the entry of said pair of broadening rolls by a slab width detector; and calculating said amount of roll gap correction of said pair of broadening rolls on the basis of deviations of the detected values of said variations in the slab width from a predicted width of said slab.

3. The method as claimed in claim 2, which comprises calculating said amount of roll gap correction of said pair of broadening rolls by the following two formulae:

$$\text{Amount of roll gap correction} = \sqrt[n^*]{\frac{\Delta B_C - \Delta B}{C \cdot f(h,B,D)}} - \Delta H_{Cset} \quad (1)$$

$$\Delta B_C = C \cdot \Delta H_{Cset}^{n^*} \cdot f(h, B, D) \quad (2)$$

in the formulae (1) and (2):

$\Delta B_C$: amount of width broadening of said slab at the exit of said pair of broadening rolls;

$n_0$, C: constants dependent on the steel grade and the extraction temperature from the heating furnace of said slab;

h: thickness of said slab at the entry of said pair of broadening rolls;

B: width of said slab at the entry of said pair of broadening rolls;

D: outside diameter of said broadening roll including the annular projection thereof; and, $\Delta H_{C\,set}$: initially set reduction of the pair of broadening rolls.

4. The method as claimed in claim 1, which comprises:

predicting by calculating variations in the width of said slab at the entry of said pair of broadening rolls;

tabulating said variations in the slab width on the basis of the predicted values of said variations in the slab width;

calculating the amounts of necessary width broadening at the top portion and the bottom portion of said slab at the exit of said pair of broadening rolls on the basis of the tabulation thus prepared of said variations in the slab width; and calculating said amount of roll gap correction of said pair of broadening rolls on the basis of said predicted values of variations in the slab width and said amounts of necessary width broadening.

5. The method as claimed in claim 4, wherein said predicted values of said variations in the width of said slab are calculated by the following four formulae:

$$\Delta B_{Ti} = \Delta B_{ETi} + \Delta B_i - \Delta b_{Ti} \quad (3)$$
$$\Delta B_{ETi} = (C_1 \cdot B_{i-1} + C_2) \cdot H_{i-1}^{n1} \cdot \Delta B_{Ei}^{n2}$$
$$\Delta b_{Ti} = (C_3 \cdot B_{i-1} \cdot \Delta H_{di} + C_4) \frac{\Delta H_i^{n3}}{H_{i-1}^{n4}} \cdot f(\Delta B_{Ei}, \Delta B_{Ti-1})$$

$$\Delta B_{Bi} = \Delta B_{E\,Bi} + \Delta B_i - \Delta b_{Bi} \quad (4)$$
$$\Delta B_{E\,Bi} \simeq 0$$
$$\Delta b_{Bi} = (C_5 \cdot B_{i-1} \cdot \Delta H_{di} C_6) \frac{\Delta H_i^{n5}}{H_{i-1}^{n6}} \cdot f(\Delta B_{Ei}, \Delta B_{Bi-1})$$

$$\Delta L_{Ti} = \Delta L_{E\,Ti} \frac{H_{i-1}}{H_i} \cdot \alpha_{Ti} \quad (5)$$
$$\Delta L_{E\,Ti} = C_7 \cdot H_{i-1}^{n7} \cdot B_{Ei}^{n8}$$

$$\Delta L_{Bi} = \Delta L_{E\,Bi} \cdot \frac{H_{i-1}}{H_i} \alpha_{Bi} \quad (6)$$
$$\Delta L_{E\,Bi} = C_8 \cdot H_{i-1}^{n9} \cdot \Delta B_{Ei}^{n10}$$

in the formulae (3), (4), (5) and (6):

i: Pass number of the hot roughing mill;

$\Delta B_{Ti}$: width shortage in the slab width direction at the top portion of said slab after horizontal reduction in the i-th pass;

$\Delta B_{Bi}$: width shortage in the slab width direction at the bottom portion of said slab after horizontal reduction in the i-th pass;

$\Delta B_{E\,Ti}$: width shortage in the slab width direction at the top portion of said slab after slab width reduction in the i-th pass;

$\Delta B_{E\,Bi}$: width shortage in the slab width direction at the bottom portion of said slab after slab width reduction in the i-th pass;

$\Delta b_{Ti}$: width broadening in the slab width direction at the top portion of said slab after horizontal reduction in the i-th pass;

$\Delta b_{Bi}$: width broadening in the slab width direction at the bottom portion of said slab after horizontal reduction in the i-th pass;

$\Delta L_{Ti}$: width shortage in the slab longitudinal direction at the top portion of said slab after horizontal reduction in the i-th pass;

$\Delta L_{Bi}$: width shortage in the slab longitudinal direction at the bottom portion of said slab after horizontal reduction in the i-th pass;

$\Delta L_{E\,Ti}$: length of the dog bone at the non-stationary portion of the slab top portion after width reduction of said slab in the i-th pass;

$\Delta L_{E\,Bi}$: length of the dog bone at the non-stationary portion of the slab bottom portion after width reduction of said slab in the i-th pass;

$H_{i-1}$: slab thickness at the entry in the i-th pass;

$B_{i-1}$: slab width at the entry in the i-th pass;

$\Delta B_{Ei}$: slab width reduction in the i-th pass;

$\Delta H_i$: slab horizontal reduction in the i-th pass;

$\Delta B_i$: width broadening in the slab width direction at stationary portion of said slab by horizontal reduction in the i-th pass;

$C_1 \sim C_8$: constants dependent on the steel grade of the slab, the slab extraction temperature from the heating furnace, the diameter of the vertical roll and other conditions;

$n_1 \sim n_{10}$: constants dependent on the steel grade of the slab, the slab extraction temperature from the heating furnace and other conditions;

$\alpha_{Ti}$: correction coefficient of elongation at the top portion of said slab; and, $\alpha_{Bi}$: correction coefficient of elongation at the bottom portion of said slab.

6. The method as claimed in claim 4, wherein said amounts of necessary width broadening "$\Delta B_C(l_x)$", at the top portion and the bottom portion of said slab, and said amount of roll gap correction of said pair of broadening rolls are calculated by the following four formulae:

$\Delta B_C(l_x)$ at the top portion of said slab $$= \Delta B_C + \Delta B_T \left\{ 1 - \left( \frac{l_x}{\Delta L_T} \right) \right\}^n \quad (7)$$

$\Delta B_C(l_x)$ at the bottom portion of said slab $$= \Delta B_C + \frac{\Delta B_B}{(L - \Delta L_B)^n - L^n} \{(L - \Delta L_B)^n - l_x^n\} \quad (8)$$

$$\Delta B_C = C \cdot H_{C\,set}^{no} \cdot f(h, B, D) \quad (2)$$

$$\text{Amount of roll gap correction} = \sqrt[no]{\frac{\Delta B_C(l_x)}{C \cdot f(h, B, D)}} - \Delta H_{Cset} \quad (9)$$

in the formulae (7), (8), (2) and (9):

$\Delta B_C$: amount of width broadening at the stationary portion of said slab;

$\Delta B_T$: width shortage in the slab width direction at the top portion of said slab;

$\Delta B_B$: width shortage in the slab width direction at the bottom portion of said slab;

$\Delta L_T$: width shortage in the slab longitudinal direction at the top portion of said slab;

$\Delta L_B$: width shortage in the slab longitudinal direction at the bottom portion of said slab;

L: longitudinal length of said slab;

$l_x$: longitudinal length of the top portion of said slab from the top end thereof;

n: index approximating variations in the slab width at the top portion and the bottom portion of said slab;

$n_0$, C: constants dependent on the steel grade and the extraction temperature from the heating furnace of said slab;

$\Delta H_{C\,set}$: initially set reduction of said pair of broadening rolls;

h: thickness of said slab at the entry of said pair of broadening rolls;

B: width of said slab at the entry of said pair of broadening rolls; and,

D: outside diameter of said broadening roll including the annular projection thereof.

7. The method as claimed in claim 1, which comprises:

calculating predicted values of variations in the width of said slab at the entry of said pair of broadening rolls by the following formulae (3) to (6):

$$\Delta B_{Ti} = \Delta B_{ETi} + \Delta B_i - \Delta b_{Ti} \quad (3)$$
$$\Delta B_{ETi} = (C_1 \cdot B_{i-1} + C_2) \cdot H_{i-1}^{n1} \cdot \Delta B_{Ei}^{n2}$$
$$\Delta b_{Ti} = (C_3 \cdot B_{i-1} \cdot \Delta H_{di} + C_4) \frac{\Delta H_i^{n3}}{H_{i-1}^{n4}} \cdot f(\Delta B_{Ei}, \Delta B_{Ti-1})$$

$$\Delta B_{Bi} = \Delta B_{E\,Bi} + \Delta B_i - \Delta b_{Bi} \quad (4)$$
$$\Delta B_{E\,Bi} \simeq 0$$
$$\Delta b_{Bi} = (C_5 \cdot B_{i-1} \cdot \Delta H_{di} C_6) \frac{\Delta H_i^{n5}}{H_{i-1}^{n6}} \cdot f(\Delta B_{Ei}, \Delta B_{Bi-1})$$

$$\Delta L_{Ti} = \Delta L_{E\,Ti} \frac{H_{i-1}}{H_i} \cdot \alpha_{Ti} \quad (5)$$
$$\Delta L_{E\,Ti} = C_7 \cdot H_{i-1}^{n7} \cdot B_{Ei}^{n8}$$

$$\Delta L_{Bi} = \Delta L_{E\,Bi} \cdot \frac{H_{i-1}}{H_i} \alpha_{Bi} \quad (6)$$
$$\Delta L_{E\,Bi} = C_8 \cdot H_{i-1}^{n9} \cdot \Delta B_{Ei}^{n10}$$

in the formulae (3), (4), (5) and (6):

i: Pass number of the hot roughing mill;

$\Delta B_{Ti}$: width shortage in the slab width direction at the top portion of said slab after horizontal reduction in the i-th pass;

$\Delta B_{Bi}$: width shortage in the slab width direction at the bottom portion of said slab after horizontal reduction in the i-th pass;

$\Delta B_{E\,Ti}$: width shortage in the slab width direction at the top portion of said slab after slab width reduction in the i-th pass;

$\Delta B_{E\,Bi}$: width shortage in the slab width direction at the bottom portion of said slab after slab width reduction in the i-th pass;

$\Delta b_{Ti}$: width broadening in the slab width direction at the top portion of said slab after horizontal reduction in the i-th pass;

$\Delta b_{Bi}$: width broadening in the slab width direction at the bottom portion of said slab after horizontal reduction in the i-th pass;

$\Delta L_{Ti}$: width shortage in the slab longitudinal direction at the top portion of said slab after horizontal reduction in the i-th pass;

$\Delta L_{Bi}$: width shortage in the slab longitudinal direction at the bottom portion of said slab after horizontal reduction in the i-th pass;

$\Delta L_{E\,Ti}$: length of the dog bone at the non-stationary portion of the slab top portion after width reduction of said slab in the i-th pass;

$\Delta L_{E\,Bi}$: length of the dog bone at the non-stationary portion of the slab bottom portion after width reduction of said slab in the i-th pass;

$H_{i-1}$: slab thickness at the entry in the i-th pass;

$B_{i-1}$: slab width at the entry in the i-th pass;

$\Delta B_{Ei}$: slab width reduction in the i-th pass;

$\Delta H_i$: slab horizontal reduction in the i-th pass;

$\Delta B_i$: width broadening in the slab width direction at stationary portion of said slab by horizontal reduction in the i-th pass;

$C_1 \sim C_8$: constants dependent on the steel grade of the slab, the slab extraction temperature from the heating furnace, the diameter of the vertical roll and other conditions;

$n_1 \sim n_{10}$: constants dependent on the steel grade of the slab, the slab extraction temperature from the heating furnace and other conditions;

$\alpha_{Ti}$: correction coefficient of elongation at the top portion of said slab; and, $\alpha_{Bi}$: correction coefficient of elongation at the bottom portion of said slab;

converting said variations in the slab width into a pattern on the basis of said predicted values of said variations in the slab width;

calculating the amounts of necessary width broadening at the top portion and the bottom portion of said slab at the exit of said pair of broadening rolls on the basis of said pattern of the variations in the slab width by the formulae (7), (8) and (2) set forth below; and calculating the amount of roll gap correction of said pair of broadening rolls on the basis of said predicted values of variations in the slab width and said amounts of necessary width broadening by formula (9) set forth below:

$\Delta B_C(l_x)$ at the top portion of said slab $$= \Delta B_C + \Delta B_T \left\{ 1 - \left( \frac{l_x}{\Delta L_T} \right) \right\}^n \quad (7)$$

$\Delta B_C(l_x)$ at the bottom portion of said slab $$= \Delta B_C + \frac{\Delta B_B}{(L - \Delta L_B)^n - L^n} \{(L - \Delta L_B)^n - l_x^n\} \quad (8)$$

$$\Delta B_C = C \cdot H_{C\,set}^{no} \cdot f(h, B, D) \quad (2)$$

$$\text{Amount of roll gap correction} = \sqrt[no]{\frac{\Delta B_C(l_x)}{C \cdot f(h, B, D)}} - \Delta H_{Cset} \quad (9)$$

in the formulae (7), (8), (2) and (9):

$\Delta B_C$: amount of width broadening at the stationary portion of said slab;

$\Delta B_T$: width shortage in the slab width direction at the top portion of said said slab;

$\Delta B_B$: width shortage in the slab width direction at the bottom portion of said slab;

$\Delta L_T$: width shortage in the slab longitudinal direction at the top portion of said slab;

$\Delta L_B$: width shortage in the slab longitudinal direction at the bottom portion of said slab;

L: longitudinal length of said slab;

$l_x$: longitudinal length of the top portion of said slab from the top end thereof;

n: index approximating variations in the slab width at the top portion and the bottom portion of said slab;

$n_0$, C: constants dependent on the steel grade and the extraction temperature from the heating furnace of said slab;

$\Delta H_{C\,set}$: initially set reduction of said pair of braodening rolls;

h: thickness of said slab at the entry of said pair of broadening rolls;

B: width of said slab at the entry of said pair of broadening rolls; and

D: outside diameter of said broadening roll including the annular projection thereof.

8. The method as claimed in any of claims 1 to 6 or 7, wherein said at least one annular projection of said pair of broadening rolls satisfies the following two formulae:

$$\Sigma W \leqq (\text{Bar width})/2, \text{ and}$$

$$H \geqq (\text{reduction})/2,$$

wherein in the two formulae:

ΣW: total of the widths of said at least one annular projection;

Bar: intermediate product obtained by rough-rolling said slab by said hot roughing mill;

H: height of said annular projection; and,

Reduction: amount of reduction by said pair of broadening rolls.

9. The method as claimed in any one of claims 1 to 6 or 7, wherein said at least one annular projection of said horizontal broadening rolls is formed at right angles with the axis of the respective broadening roll.

10. The method as claimed in claim 9, wherein said annular projection of each of said broadening rolls is substantially at the center of the broadening rolls in the longitudinal direction of the broadening rolls.

* * * * *